US012774548B2

(12) United States Patent
Ohyagi et al.

(10) Patent No.: US 12,774,548 B2
(45) Date of Patent: Oct. 27, 2026

(54) DRUM-TYPE WASHING MACHINE

(71) Applicant: Samsung Electronics Co., Ltd., Suwon-si (KR)

(72) Inventors: Atsushi Ohyagi, Yokohama (JP); Yasushi Urai, Yokohama (JP); Takuro Sakamaki, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 101 days.

(21) Appl. No.: 18/783,872

(22) Filed: Jul. 25, 2024

(65) Prior Publication Data

US 2025/0198071 A1 Jun. 19, 2025

Related U.S. Application Data

(63) Continuation of application No. PCT/KR2024/010561, filed on Jul. 22, 2024.

(30) Foreign Application Priority Data

Dec. 14, 2023 (JP) ..... 2023-211510

(51) Int. Cl.
*D06F 34/18* (2020.01)
*D06F 23/02* (2006.01)
(Continued)

(52) U.S. Cl.
CPC ..... *D06F 34/18* (2020.02); *D06F 23/02* (2013.01); *D06F 37/22* (2013.01); *D06F 39/125* (2013.01);
(Continued)

(58) Field of Classification Search
None
See application file for complete search history.

(56) References Cited

U.S. PATENT DOCUMENTS

| | | | | |
|---|---|---|---|---|
| 4,813,504 | A * | 3/1989 | Kroll | G01G 3/1402 73/862.632 |
| 7,555,960 | B2 | 7/2009 | Nakano et al. | |
| 10,927,488 | B2 * | 2/2021 | Funakoshi | D06F 33/48 |
| 2020/0109508 | A1 | 4/2020 | Oh et al. | |
| 2021/0207308 | A1 | 7/2021 | Stücheli et al. | |
| 2022/0247292 | A1 | 8/2022 | Takahashi et al. | |

FOREIGN PATENT DOCUMENTS

| | | |
|---|---|---|
| CN | 1268596 A | 10/2000 |
| CN | 110894659 A | 3/2020 |

(Continued)

OTHER PUBLICATIONS

Y. Yuan, "Sensor fusion based testing station for unbalanced load estimation in horizontal washing machines," 2008 IEEE Instrumentation and Measurement Technology Conference, Victoria, BC, Canada, pp. 1424-1428, doi: 10.1109/IMTC.2008.4547266. (Year: 2008).*

International Search Report dated Oct. 23, 2024 for International Application No. PCT/KR2024/010561.

*Primary Examiner* — Rita P Adhlakha
(74) *Attorney, Agent, or Firm* — STAAS & HALSEY LLP

(57) ABSTRACT

A washing machine including a housing; a tub in the housing; a rotatable drum in the tub; and a plurality of leg portions couplable to the housing to support the housing on a mounting surface, wherein each leg portion includes a support leg, a reinforcement bracket couplable to a lower surface of the housing, and a weight measurement device couplable to the reinforcement bracket, wherein each leg portion is configured so that, when the weight measurement device is coupled to the reinforcement bracket and the reinforcement bracket is coupled to the lower surface of the housing, the housing is supported so that a lower surface of the housing is spaced apart from the mounting surface, and the weight measurement device is supported on the support
(Continued)

leg and located between the lower surface of the housing and the reinforcement bracket, and measures a weight applied on the leg portion.

15 Claims, 9 Drawing Sheets

(51) Int. Cl.

| | |
|---|---|
| ***D06F 37/22*** | (2006.01) |
| ***D06F 39/12*** | (2006.01) |
| ***D06F 103/04*** | (2020.01) |
| ***D06F 105/48*** | (2020.01) |

(52) U.S. Cl.
CPC ..... *D06F 2103/04* (2020.02); *D06F 2105/48* (2020.02)

(56) References Cited

FOREIGN PATENT DOCUMENTS

| | | |
|---|---|---|
| JP | 5-146582 | 6/1993 |
| JP | 4887260 | 2/2012 |
| JP | 5858951 | 2/2016 |
| JP | 2023-42592 | 3/2023 |
| KR | 10-2006-0031067 | 4/2006 |
| KR | 10-2006-0039183 | 5/2006 |
| KR | 10-1139447 | 4/2012 |
| KR | 10-1828397 | 3/2018 |
| KR | 10-2020-0038627 | 4/2020 |
| KR | 10-2547840 | 6/2023 |
| WO | WO 2012/089442 A1 | 7/2012 |

* cited by examiner

DRUM-TYPE WASHING MACHINE

CROSS-REFERENCE TO RELATED APPLICATIONS

This application is a continuation application, under 35 U.S.C. § 111(a), of International Application No. PCT/KR2024/010561, filed on Jul. 22, 2024, which claims priority under 35 U.S.C. § 119 to Japanese Patent Application No. 2023-211510, filed on Dec. 14, 2023, the disclosures of which are incorporated by reference herein in their entireties.

TECHNICAL FIELD

The disclosure relates to a drum-type washing machine. The disclosure relates to a drum-type washing machine capable of suppressing increased vibration of a housing due to resonance. The disclosure relates to a drum-type washing machine capable of measuring the weight of laundry, etc., with high precision.

BACKGROUND ART

A washer-dryer unit may be made by mounting a dryer on a washing machine. In this case, the weight of the washing machine and the weight of the dryer that are combined may be applied to a leg portion of the washing machine. When the weight applied on the leg portion of the washing machine increases, the resonant frequency between the washing machine and a mounting surface, for example, a floor surface, may decrease, and the number of revolutions of the washing machine (the number of dewatering revolutions) during a dewatering process may match with the resonant frequency, which leads to a higher possibility of an increase of vibration. During the dewatering process, there is a maintenance section during which the number of dewatering revolutions is maintained constant taking into account the time for water drainage from clothes. When the number of dewatering revolutions and the resonant frequency match with each other in the maintenance section, the washer-dryer unit has a greater overall height than the washing machine, which may cause the washing machine to shake more violently in the maintenance section, resulting in the occurrence of loud noise.

For efficient driving of the washing machine, it is important to accurately measure the weight of laundry before a washing process. In the case of a drum-type washing machine of the related art, a drum in which laundry is accommodated may be rotated, and based on the inertia moment of the loaded drum, the weight of the laundry may be estimated. However, according to this method, as the weight of the laundry increases, the degree of precision may be reduced.

JP Patent Gazette 5-146582 discloses a top-loading type washing machine that directly measures the weight of the laundry inserted into a wash tub by using a weight sensor mounted on a leg portion of a body of the washing machine. The weight sensor is a semiconductor pressure sensor that uses a resistance change due to the piezo resistance effect of a semiconductor strain gauge and converts diaphragm deformation of the weight sensor into an electrical signal.

DISCLOSURE

Technical Solution

Aspects of embodiments of the disclosure will be set forth in part in the description which follows and, in part, will be apparent from the description, or may be learned by practice of the presented embodiments.

According to an embodiment of the disclosure, a washing machine includes a housing; a tub accommodated in the housing and configured to retain water; a drum accommodated in the tub and configured to be rotatable; and a plurality of leg portions configured to be couplable to the housing to support the housing on a mounting surface, wherein each leg portion of the plurality of leg portions includes a support leg, a reinforcement bracket configured to be couplable to a lower surface of the housing, and a weight measurement device configured to be couplable to the reinforcement bracket, wherein the each leg portion is configured so that, when the weight measurement device is coupled to the reinforcement bracket and the reinforcement bracket is coupled to the lower surface of the housing, the housing is supported on the support leg so that a lower surface of the housing is spaced apart from the mounting surface, and the weight measurement device is supported on the support leg and located between the lower surface of the housing and the reinforcement bracket, and measures a weight applied on the each leg portion.

According to an embodiment of the disclosure, the reinforcement bracket, the support leg, and the weight measurement device may integrally form a unit leg portion.

According to an embodiment of the disclosure, an accommodation concave portion may be recessed on the lower surface of the housing to accommodate the weight measurement device.

According to an embodiment of the disclosure, when the weight measurement device is coupled to the reinforcement bracket and the reinforcement bracket is coupled to the lower surface of the housing, the reinforcement bracket may cover the accommodation concave portion and the weight measurement device may be accommodated in the accommodation concave portion.

According to an embodiment of the disclosure, the weight measurement device may include a straining body having a first end, a second end, and a central portion, and a strain gauge coupled to the straining body and configured to detect deformation of the straining body. When the weight measurement device is coupled to the reinforcement bracket and the reinforcement bracket is coupled to the lower surface of the housing, the first end of the straining body and the second end of the straining body may be fixed to the reinforcement bracket, and the central portion of the straining body may be fixed to the support leg.

According to an embodiment of the disclosure, the straining body may include chrome molybdenum steel.

According to an embodiment of the disclosure, the straining body may include an antirust processed surface.

According to an embodiment of the disclosure, the weight measurement device may include an amplification circuit configured to amplify and output a detection signal input from the strain gauge, a wire guide supporting the amplification circuit, and a first lead line extending from the strain gauge and guided along a surface of the wire guide to be connected to the amplification circuit. When the weight measurement device is coupled to the reinforcement bracket, the wire guide may be coupled to the reinforcement bracket.

According to an embodiment of the disclosure, the wire guide may include a main member having a first end and a second end, the amplification circuit being coupled to the first end of the main member, a lead line accommodation portion at the second end of the main member and accommodating the first lead line extending from the strain gauge, a sub-member coupled to the main member to cover the lead line accommodation portion, and a lead line guide configured in the main member to guide a portion of the first lead line extending from the lead line accommodation portion so as not to float from an upper surface of the main member.

According to an embodiment of the disclosure, the straining body may include a base portion having a first end and a second end, and a pair of arm portions extending respectively from the first end of the base portion and the second end of the base portion. The strain gauge may be coupled to each arm portion of the pair of arm portions.

According to an embodiment of the disclosure, the strain gauge may include two detection devices. The two detection devices may be arranged in a lengthwise direction of the pair of arm portions.

According to an embodiment of the disclosure, the washing machine may further include a shaft support boss that is insertable into a boss fixing hole in the base portion of the straining body. The support leg may include a screw shaft portion that is insertable in a shaft hole in the shaft support boss, and a ground plate coupled to a lower end of the screw shaft portion, and configured to be supportable on the mounting surface.

According to an embodiment of the disclosure, the washing machine may further include a control device configured to perform, based on a measurement result of the weight measurement device on the each leg portion, a laundry weight measurement process to measure a weight of laundry accommodated in the drum.

According to an embodiment of the disclosure, the washing machine may further include a control device configured to perform, based on a measurement result of the weight measurement device on the each leg portion, a resonant vibration suppression process to avoid an increase of resonant vibration during a dewatering process.

According to an embodiment of the disclosure, the control device may be configured to maintain a number of revolutions of the drum as a first number of dewatering revolutions in a maintenance section for maintaining the number of revolutions of the drum to be constant during the dewatering process, and detect, based on the measurement result of the weight measurement device on the each leg portion, an occurrence of increased vibration of the housing, and change the number of revolutions of the drum in the maintenance section to a second number of dewatering revolutions which is different from the first number of dewatering revolutions.

DESCRIPTION OF DRAWINGS

The above and other aspects, features, and advantages of certain embodiments of the disclosure will be more apparent from the following description, taken in conjunction with the accompanying drawings.

MODE FOR INVENTION

Figure 1:
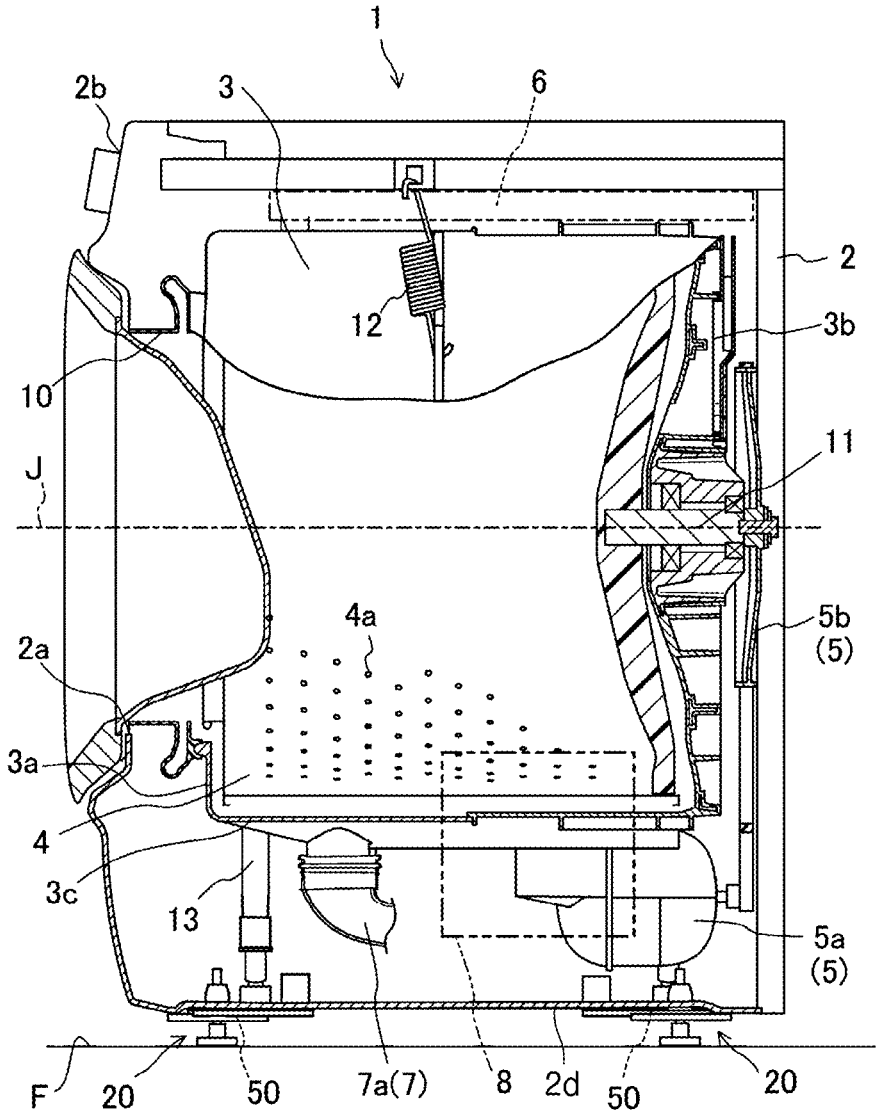
FIG. 1 is a schematic cross-sectional view of a drum-type washing machine according to an embodiment of the disclosure.

Various embodiments of the disclosure and terms used herein are not intended to limit the technical features described in this specification to particular embodiments, and it should be understood that various modifications, equivalents, or substitutes of the corresponding embodiments are also included in the technical features.

With regard to the description of the drawings, similar reference numerals may be used for similar or relevant components.

A singular form of a noun corresponding to an item may include a singular number or a plural number of the item, unless apparently otherwise indicated in the context.

In this disclosure, each of expressions such as "A or B," "at least one of A and B," "at least one of A or B," "A, B, or C," "at least one of A, B, and C," and "at least one of A, B, or C" may include any one of items listed together with the corresponding expression or all possible combinations of the same.

The expression "and/or" includes a combination of a plurality of described relevant components or any one of the plurality of described relevant components.

Terms such as "$1^{st}$," "$2^{nd}$," "first," and "second" may be merely used to distinguish a corresponding component from other corresponding components and do not limit the corresponding components in terms of other aspects (for example, the degree of importance or the order).

When a certain (for example, a first) element is referred to as being "coupled" or "connected" to another (for example, a second) element with the term "functionally" or "communicatively" or without this term, it denotes that the element may be connected to the other element directly (for example, in a wired manner), wirelessly, or through a third element.

The term "including" or "having" is used to indicate a presence of a feature, a number, a step, an operation, an element, a component, or a combination thereof described herein, and the term does not exclude a presence of one or more other features, numbers, steps, operations, elements, components, or a combination thereof or the possibility of an addition of the same.

When a certain element is referred to as being "connected to," "coupled to," "supported by," or "in contact with" another element, it denotes not only the case where the elements are directly connected to, coupled to, supported by, or in contact with each other, but also the case where the elements are indirectly connected to, coupled to, supported by, or in contact with each other through a third element.

When a certain element is referred to as being "above" another element, it includes not only the case where the element is in contact with the other element, but also the case where yet another element is present between the two components.

A washing machine according to various embodiments of the disclosure may perform washing, rinsing, dewatering, and drying operations. A washing machine is an example of a clothing processor. The clothing processor is a concept encompassing a device washing clothes (a washing object and a drying object), a device drying clothes, and a device both washing and drying clothes.

Washing machines according to various embodiments of the disclosure may include top-loading washing machines in which a laundry inlet for inputting or withdrawing the laundry is provided toward a top side or front-loading washing machines in which a laundry inlet is provided toward a front side. The washing machines according to various embodiments of the disclosure may include other loading-type washing machines in addition to the top-loading washing machines and the front-loading washing machines.

The top-loading washing machines may wash laundry by using water flow generated by a rotor such as a pulsator. The front-loading washing machines may wash laundry by repeatedly uplifting and dropping the laundry by rotating a drum. The front-loading washing machines may include drying-combined washing machines capable of drying laundry accommodated in a drum. The drying-combined washing machines may include a hot wind supply device for supplying high temperature air into the drum and a condensing device for removing moisture of the air withdrawn from the drum. For example, the drying-combined washing machines may include a heat pump device. The washing machines according to various embodiments of the disclosure may include washing machines of other types than the washing types described above.

The washing machines according to various embodiments of the disclosure may include a housing in which various components are accommodated. The housing may be provided as a box on a side of which a laundry inlet is formed.

The washing machines may include a door for opening or closing the laundry inlet. The door may be mounted on the housing to be rotatable through a hinge. At least a portion of the door may be provided to be transparent or semi-transparent so that the inside of the housing is visible.

The washing machines may include a tub provided in the housing to retain water. The tub may be provided to have an approximately cylindrical shape on a side of which a tub opening is formed and may be arranged in the housing such that the tub opening is arranged to correspond to the laundry inlet.

The tub may be connected to the housing by a damper. The damper may offset vibration, which is generated during rotation of the drum and transmitted to the housing, by absorbing the vibration.

The washing machines may include the drum provided to accommodate the laundry.

The drum may be arranged in the tub such that a drum opening on a side of the drum corresponds to the laundry inlet and the tub opening. The laundry may be accommodated in the drum or withdrawn from the drum by sequentially passing through the laundry inlet, the tub opening, and the drum opening.

The drum may rotate in the tub and may perform operations in accordance with washing, rinsing, and/or dewatering processes. A plurality of through-holes may be formed in a cylindrical wall of the drum, and thus, water stored in the tub may be introduced into the drum or may be discharged from the drum.

The washing machines may include a driving device configured to rotate the drum. The driving device may include a driving motor and a rotation shaft for transmitting a driving force generated from the driving motor to the drum. The rotation shaft may be connected to the drum by passing through the tub.

The driving device may rotate or reversely rotate the drum to perform operations in accordance with washing, rinsing, dewatering, and/or drying processes.

The washing machines may include a water supply device configured to supply water to the tub. The water supply device may include a water supply pipe and a water supply valve provided in the water supply pipe. The water supply pipe may be connected to an external water supply source. The water supply pipe may extend from the external water supply source to a detergent supply device and/or the tub. Water may be supplied to the tub through the detergent supply device. Water may be supplied to the tub without passing through the detergent supply device.

The water supply valve may open or close the water supply pipe in response to an electrical signal of a controller. The water supply valve may allow or block the supplying of water from the external water source to the tub. The water supply valve may include, for example, a solenoid valve opened or closed in response to an electrical signal.

The washing machine may include the detergent supply device configured to supply a detergent to the tub. The detergent supply device may include a manual detergent supply device, whereby a user has to input a detergent to be used, for every washing, and an automatic detergent supply device, whereby a large amount of detergent is stored and a certain amount of detergent is automatically input during washing. The detergent supply device may include a detergent container to store the detergent. The detergent supply device may be configured to supply the detergent into the tub during a water supply process. Water supplied through the water supply pipe may be mixed with the detergent by passing through the detergent supply device. The water mixed with the detergent may be supplied into the tub. The detergent may be used as a term to encompass a preliminary washing detergent, an actual washing detergent, a fabric softener, a bleaching agent, etc., and the detergent container may be sectioned into a storage area for a preliminary washing detergent, a storage area for an actual washing detergent, a storage area for a fabric softener, and a storage area for a bleaching agent.

The washing machines may include a water drainage device configured to discharge water accommodated in the tub to the outside. The water drainage device may include a water drainage pipe extending from below the tube to the outside of the housing, a water drainage valve provided on the water drainage pipe to open or close the water drainage pipe, and a pump provided on the water drainage pipe. The pump may pump the water in the water drainage pipe to the outside of the housing.

The washing machines may include a control panel arranged on a side surface of the housing. The control panel may provide a user interface for interaction between a user and the washing machines. The user interface may include at least one input interface and at least one output interface.

The at least one input interface may convert sensory information received from the user to an electrical signal.

The at least one input interface may include a power button, an operation button, a course selection dial (or a course selection button), and a washing/rinsing/dewatering setting button. The at least one input interface may include, for example, a tact switch, a push switch, a slide switch, a toggle switch, a micro switch, a touch switch, a touch pad, a touch screen, a jog dial, and/or a microphone.

The at least one output interface may visually or audibly transmit information about an operation of the washing machines to the user.

For example, the at least one output interface may transmit a washing course and an operation time of the washing machines and information about washing setting/rinsing setting/dewatering setting to the user. The information about the operation of the washing machines may be output through a screen, an indicator, sound, etc. The at least one output interface may include, for example, a liquid crystal display (LCD) panel, a light-emitting diode (LED) panel, a speaker, etc.

The washing machines may include a communication module for wired and/or wireless communicating with an external device.

The communication module may include at least one of a short-range communication module or a remote communication module.

The communication module may transmit data to an external device (for example, a server, a user device, and/or a home appliance) or receive data from the external device. For example, the communication module may establish communication and exchange various data with the server, the user device, and/or the home appliance.

To this end, the communication module may establish a direct (for example, wired) communication channel or a wireless communication channel between the washing machines and the external device and may support communication performed through the established communication channel. According to an embodiment of the disclosure, the communication module may include a wireless communication module (e.g., a cellular communication module, a short-range wireless communication module, or a global navigation satellite system (GNSS) communication module) or a wired communication module (e.g., a local area network (LAN) communication module or a power line communication module). A corresponding communication module from among these communication modules may communicate with the external device through a first network (e.g., a short-range wireless communication network, such as Bluetooth, wireless fidelity (Wifi) direct, or infrared data association (IrDA)) or a second network (e.g., a remote communication network, such as a legacy cellular network, a fifth generation (5G) network, a next-generation communication network, the Internet, or a computer network (e.g., a LAN or a wide area network (WAN))). Various types of these communication modules may be integrated into one element (e.g., a single chip) or may be realized as a plurality of different elements (e.g., a plurality of chips).

The short-range wireless communication module may include a Bluetooth communication module, a Bluetooth low energy (BLE) communication module, a near-field communication (NFC) module, a WLAN (or Wifi) communication module, a Zigbee communication module, an IrDA communication module, a Wifi direct (WFD) communication module, an ultra-wideband (UWB) communication module, an Ant+ communication module, a microwave (μWave) communication module, etc. but is not limited thereto.

The remote communication module may include communication modules for performing various types of remote communication and may include a mobile communicator. The mobile communicator may transceive a wireless signal with at least one of a base station, an external terminal, or a server on a mobile communication network.

According to an embodiment of the disclosure, the communication module may communicate with an external device, such as a server, a user device, a different home appliance, etc., through a peripheral access point (AP). The AP may connect a LAN, to which the washing machines or a user device are connected, to a WAN to which a server is connected. The washing machine or the user device may be connected to the server through the WAN. The controller may control various components (e.g., the driving motor and the water supply valve) of the washing machines. According to a user input, the controller may control various components of the washing machines to perform at least one process including water supplying, washing, rinsing, and/or dewatering. For example, the controller may control the driving motor to adjust a rotation speed of the drum or control the water supply valve of the water supply device to supply water to the tub.

The controller may include hardware, such as a central processing unit (CPU), a memory, etc., and software, such as a control program, etc. For example, the controller may include at least one memory storing data in the form of an algorithm or a program for controlling operations of the components in the washing machines and at least one processor configured to perform the operations described above by using the data stored in the at least one memory. The memory and the processor may each be realized as a separate chip. The processor may include at least one or two processor chips or at least one or two processing cores. The memory may include at least one or two memory chips or at least one or two memory blocks. Also, the memory and the processor may be realized as a single chip.

When the weight of the laundry is directly measured by using a weight sensor, not only the weight of the laundry may be highly precisely measured, but also the horizontality of a washing machine may be detected, and thus, the position of the washing machine may be determined with high precision. Also, increased vibration of a washer-dryer unit due to resonance may be detected, and the matching of the number of dewatering revolutions with a resonant frequency in a maintenance section in which the number of dewatering revolutions is maintained constant, may be avoided. However, in the case of the washer-dryer unit, the weight applied to a leg portion of the washing machine may increase, and thus, the weight sensor may require the strength and rigidity to withstand the increasing weight as well as to protect a fine structure of a detection portion. Even when the strength and rigidity is secured, when the structure becomes complex, the assembling operability may be reduced so as to be inappropriate for the yield. Also, it may be frequent that a pallet or a fork may be inserted below the washing machine for conveying or mounting the washing machine, and there is a possibility that the weight sensor may be damaged by being in contact with the pallet or the fork.

The disclosure provides a washing machine for measuring the weight of the washing machine with high precision while having the strength and rigidity to withstand an increased weight and being appropriate for the yield. However, the technical objectives to be achieved by the disclosure are not limited to the technical tasks described above, and other technical tasks that are not described above may be clearly understood by one of ordinary skill in the art from the description below.

Hereinafter, with reference to the drawings, embodiments of the washing machine according to the disclosure are described. However, the descriptions below are essentially mere examples.

Figure 2:
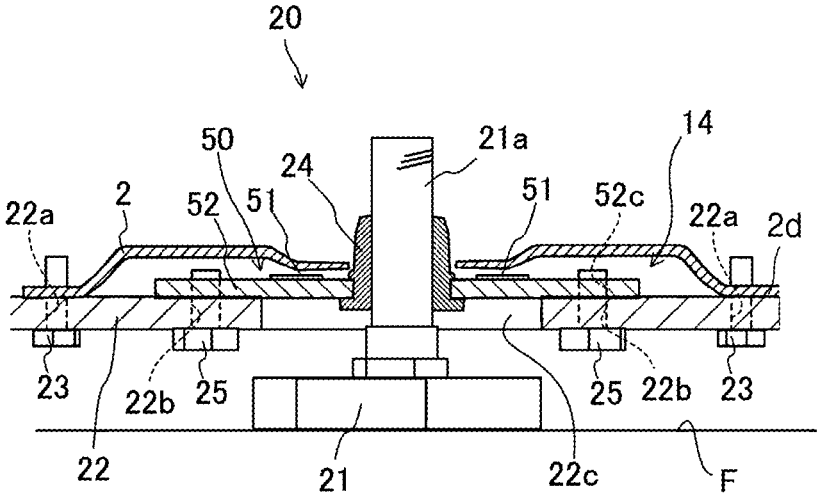
FIG. 2 is a schematic cross-sectional view of a leg portion according to an embodiment of the disclosure.

FIG. 1 is a schematic cross-sectional view of a drum-type washing machine 1 according to an embodiment of the disclosure. FIG. 2 is a schematic cross-sectional view of a leg portion 20 according to an embodiment of the disclosure. Hereinafter, the drum-type washing machine will be simply referred to as the washing machine 1. The washing machine 1 may be a so-called fully automatic washing machine configured to automatically perform a series of processes of washing, rinsing, and dewatering. The washing machine 1 according to the present embodiment of the disclosure may not have a drying function. However, the washing machine 1 may include a drying function. When the washing machine 1 does not have the drying function, the washing machine 1 may be formed as a unit (a washer-dryer unit) of a washing machine and a dryer by being combined with a dryer having a unified design (see FIG. 8).

Referring to FIGS. 1 and 2, the washing machine 1 may include a housing 2, a tub 3, a drum 4, and a plurality of leg portions 20. The housing 2 may be supported on a mounting surface F by the plurality of leg portions 20. The tub 3 capable of retaining water may be accommodated in the housing 2. The drum 4 may be accommodated in the tub 3 to be rotatable. The washing machine 1 may further include a driving device 5, a water supply device 6, a water drainage device 7, a control device 8, etc.

An exterior shape of the housing 2 may be approximately cuboid. The housing 2 may be formed by assembling a panel, etc., to a frame forming a framework. A circular inlet 2*a* opened or closed by a door may be provided on a front surface of the housing 2. Laundry may be inserted or withdrawn through the inlet 2*a*. A manipulator 2*b* manipulated by a user to operate the washing machine 1 may be provided above the inlet 2*a*. The manipulator 2*b* may include, for example, a switch, a display, etc.

The plurality of leg portions 20 may be mounted on a lower surface 2*d* of the housing 2. For example, the leg portion 20 supporting the housing 2 may be mounted on each of four locations of front, rear, right, and left edges of the lower surface 2*d* of the housing 2. The housing 2 may be supported on the mounting surface F, for example, a floor surface, by the leg portions 20, while maintaining a gap between the lower surface 2*d* of the housing 2 and the mounting surface F. The washing machine 1 may include a weight measurement device 50 allowing high-precision measurement of the weight of the laundry or water accommodated in the drum 4, in order to improve the washing performance. The weight measurement device 50 may be embedded in the leg portions 20. The leg portions 20 will be described in detail below.

The tub 3 may be a cylindrical-shaped container having a bottom, which is capable of retaining water. The tub 3 may include a front wall portion 3*a* which is ring-shaped and in which a tub opening having substantially the same diameter as the inlet 2*a* is formed, a rear wall portion 3*b* which is discoid-shaped and faces the front wall portion 3*a*, and a body wall portion 3*c* which is cylindrical-shaped and arranged between the front wall portion 3*a* and the rear wall portion 3*b*. The tub 3 may be accommodated in the housing 2 in a state in which the tub 3 is arranged in a front-rear direction such that the front wall portion 3*a* is arranged toward the front side.

The front wall portion 3*a* may be connected to the front surface of the housing 2 through an annular sealing member 10 that may be elastically deformed and a space between the inlet 2*a* and the tub 3 may be sealed by the annular sealing member 10. A shaft 11 may be mounted at the center of the rear wall portion 3*b*. The driving device 5 may rotate the shaft 11 to rotate the drum 4. The driving device 5 may include a motor 5*a*, a pulley 5*b*, a belt, etc. The pulley 5*b*, the belt, etc. may be mounted on the rear wall portion 3*b* of the tub 3 and the motor 5*a* may be mounted on a lower rear side of the tub 3.

The tub 3 may be elastically supported on the housing 2 to suppress the transmission of vibration generated when washing or dewatering to the outside of the washing machine 1. For example, a pair of suspension springs 12 may be mounted at both sides, that is, right and left sides, of an upper inner portion of the housing 2, and the tub 3 may be hung in the housing 2 by the pair of suspension springs 12. Also, a damper 13 may be mounted on each of four positions, that is, front, rear, right, and left sides of a lower inner portion of the housing 2, and the tub 3 may also be supported by these four dampers 13.

The drum 4 may be a cylindrical container having a smaller bottom than the tub 3. The drum 4 may be accommodated in the tub 3 while being arranged in the front-rear direction such that an opening of the drum 4 is toward the front side. An end of the shaft 11 protruding in a front direction from the rear wall portion 3*b* of the tub 3 may be fixed to a rear center of the drum 4. The drum 4 may be accommodated in the tub 3 to be rotatable. A plurality of water through-holes 4*a* passing through a side wall of the drum 4 may be generally formed in the side wall of the drum 4 (only some of them are illustrated in FIG. 1).

The drum 4 and the tub 3 may be arranged such that their central lines coincide with each other, and the inlet 2*a* of the housing, the tub opening of the tub 3, and the opening of the drum 4 may be aligned in the front-rear direction to be connected through one another. Through a driving operation of the motor 5*a*, the drum 4 may rotate in the tub 3 with respect to a rotation axis J that is approximately horizontal.

The water supply device 6 for supplying water from an external water supply facility, etc. to the tub 3 may be mounted above the housing 2. The water supply device 6 may include an electronic opening and closing valve, a water supply hose, etc. The water drainage device 7 may include a water drainage hose 7*a*. A water drainage hole may be mounted at a lower end of the tube 3. The water drainage hose 7*a* may be connected to the water drainage hole. An end of the water drainage hose 7*a* may be exposed to the outside of the housing 2. A pump (not shown) for draining water may be mounted on the water drainage hose 7*a*.

The control device 8 may be mounted in the housing 2 as illustrated by a virtual line in FIG. 1. The control device 8 may control overall driving operations of the washing machine 1 according to driving manipulation that is input from the manipulator 2*b*. The control device 8 may perform a series of processes including washing, rinsing, dewatering, etc., by controlling operations of the driving device 5, the water supply device 6, and the water drainage device 7. For example, the control device 8 may include hardware, such as a CPU, a memory, etc., and software, such as a control program, etc. For example, the control device 8 may include at least one memory storing data in the form of an algorithm or a program for controlling the operations of the components in the washing machine and at least one processor configured to perform the operations described above by using the data stored in the at least one memory. Each of the memory and the processor may be realized as a separate chip. The processor may include one or two or more processor chips or one or two or more processing cores. The memory may include one or two or more memory chips or one or two or more memory blocks. Also, the memory and the processor may be realized as a single chip.

The control device 8 may be configured to perform a process of measuring, based on a measurement result of the weight measurement device 50, the weight of laundry accommodated in the drum 4 (laundry weight measurement processing), to improve the washing performance. This aspect is described in detail.

The washing machine 1 according to the present embodiment of the disclosure may include the weight measurement device 50 configured to measure the weight of the laundry or the water accommodated in the drum 4. The weight measurement device 50 may be mounted on each of the leg portions 20. Each weight measurement device 50 may measure the weight applied to the corresponding leg portion 20.

Referring to FIG. 2, the leg portion 20 may include a support leg 21, a reinforcement bracket 22, and the weight measurement device 50. The support leg 21 may support the housing 2 on the mounting surface F such that the lower surface 2*d* of the housing 2 is apart from the mounting surface F. The reinforcement bracket 22 may be coupled to the lower surface 2*d* of the housing 2, for example, by a fixing bolt 23. The reinforcement bracket 22 may include, for example, a plate type member. The strength and rigidity of a portion around the leg portions 20 of the housing 2 may be increased by the reinforcement bracket 22. The weight measurement device 50 may be coupled to the reinforcement bracket 22 to be arranged between the lower surface 2*d* of the housing 2 and the reinforcement bracket 22 and may be supported on the support leg 21 and may measure the weight applied on the leg portion 20.

An accommodation concave portion 14 that is upwardly concave may be provided at a coupling portion of the lower surface 2*d* of the housing 2, to which each leg portion 20 is coupled. The accommodation concave portion 14 may be recessively formed at the lower surface 2*d* of the housing 2 to accommodate the weight measurement device 50. The height (the depth in an up and down direction) of the accommodation concave portion 14 may be slightly greater than the thickness of the weight measurement device 50 (in particular, a strain-producing body 52), and a downwardly viewed size of the accommodation concave portion 14 may be slightly greater than a downwardly viewed outline of the weight measurement device 50 (in particular, the strain-producing body 52). The weight measurement device 50 may be accommodated in the accommodation concave portion 14. The reinforcement bracket 22 may be coupled to the lower surface 2*d* of the housing 2 to cover the accommodation concave portion 14 while the weight measurement device 50 is being accommodated in the accommodation concave portion 14. Accordingly, the weight measurement device 50 may be arranged between the reinforcement bracket 22 and the support leg 21 while being positioned between the lower surface 2*d* of the housing 2 and the reinforcement bracket 22. Thus, the height of the leg portion 20 in the state in which the weight measurement device 50 is embedded in the leg portion 20 may be almost the same as the height of the leg portion 20 when the weight measurement device 50 is not embedded in the leg portion 20. That is, the weight measurement device 50 may not affect the size of the washing machine 1. In other words, the weight detection structure according to the disclosure may be highly applicable for general purposes.

When the washing machine 1 is conveyed or mounted, a pallet, a fork, etc. may be frequently inserted below the washing machine 1. In this case, when the weight measurement device 50 contacts the pallet, the fork, etc., the weight measurement device 50 having the delicate characteristics may be damaged. According to the disclosure, a lower portion of the weight measurement device 50 may be protected by the reinforcement bracket 22, and thus, damage to the weight measurement device 50 may be prevented. Based on the structure in which the weight measurement device 50 is accommodated in the accommodation concave portion 14, damage to the weight measurement device 50 may further be prevented. Also, the weight measurement device 50 may be integrally provided in the leg portion 20 together with the support leg 21 and the reinforcement bracket 22. Thus, when the leg portion 20 is coupled to the housing 2, the weight measurement device 50 may also be coupled to the housing 2 together with the leg portion 20. Thus, the assemblability and the yield may be improved. The leg portion 20 integrally provided with the support leg 21, the reinforcement bracket 22, and the weight measurement device 50 may be referred to as a "unit leg portion." That is, the unit leg portion may be treated as one unit in a manufacturing process of the washing machine 1. As the unit leg portion may be coupled to the housing 2, the weight measurement device 50 may be coupled to the housing 2 while being capable of measuring the weight applied on the leg portion 20.

Figure 3:
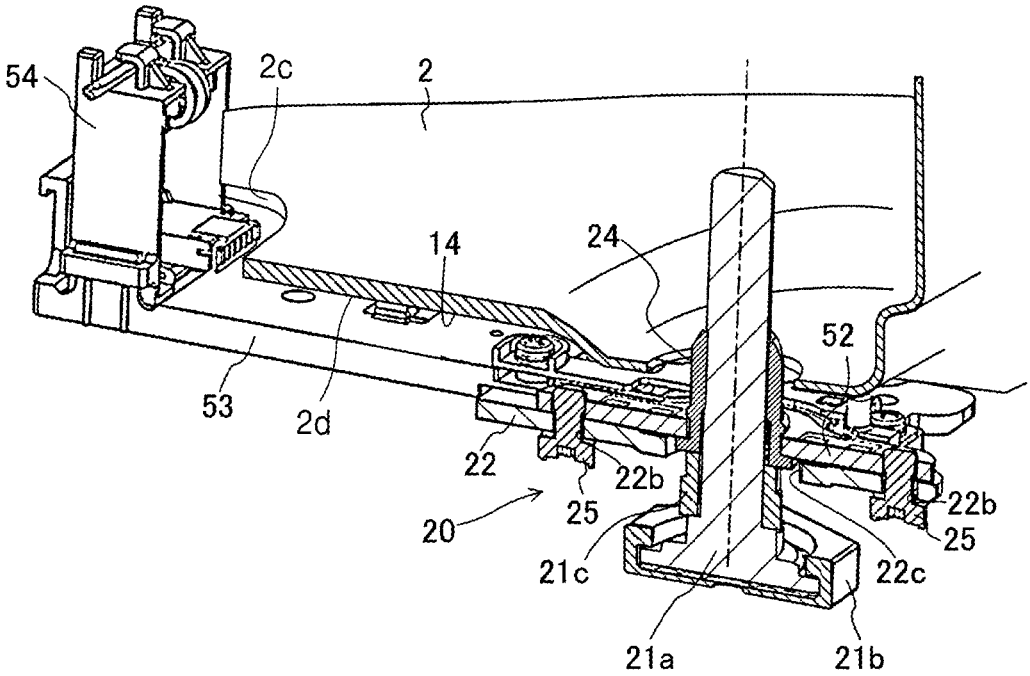
FIG. 3 is a schematic cross-sectional perspective view of a unit leg portion coupled to a housing, according to an embodiment of the disclosure.
Figure 4:
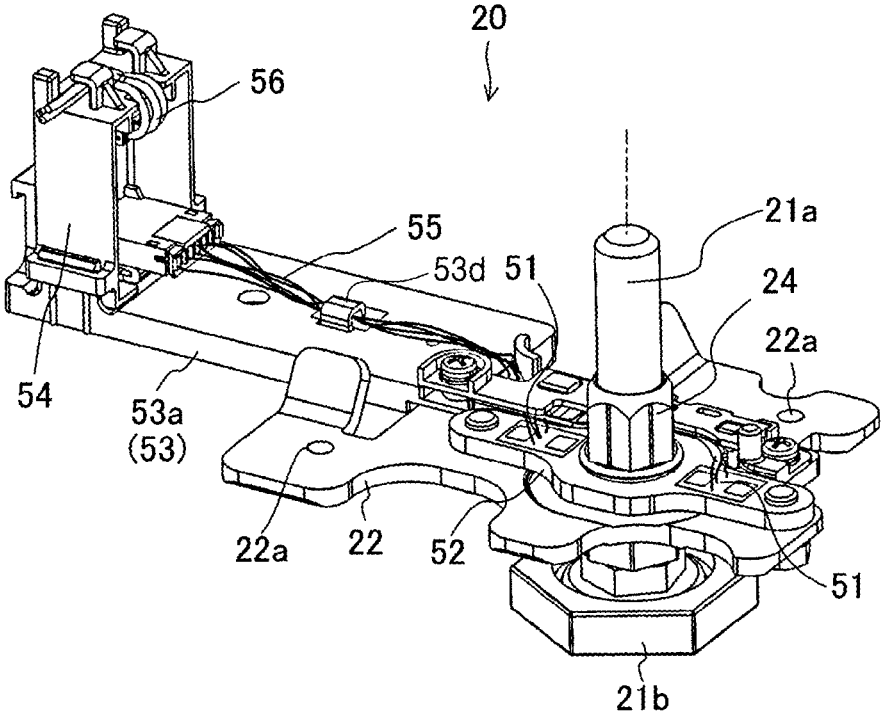
FIG. 4 is a schematic perspective view of a unit leg portion according to an embodiment of the disclosure.
Figure 5:
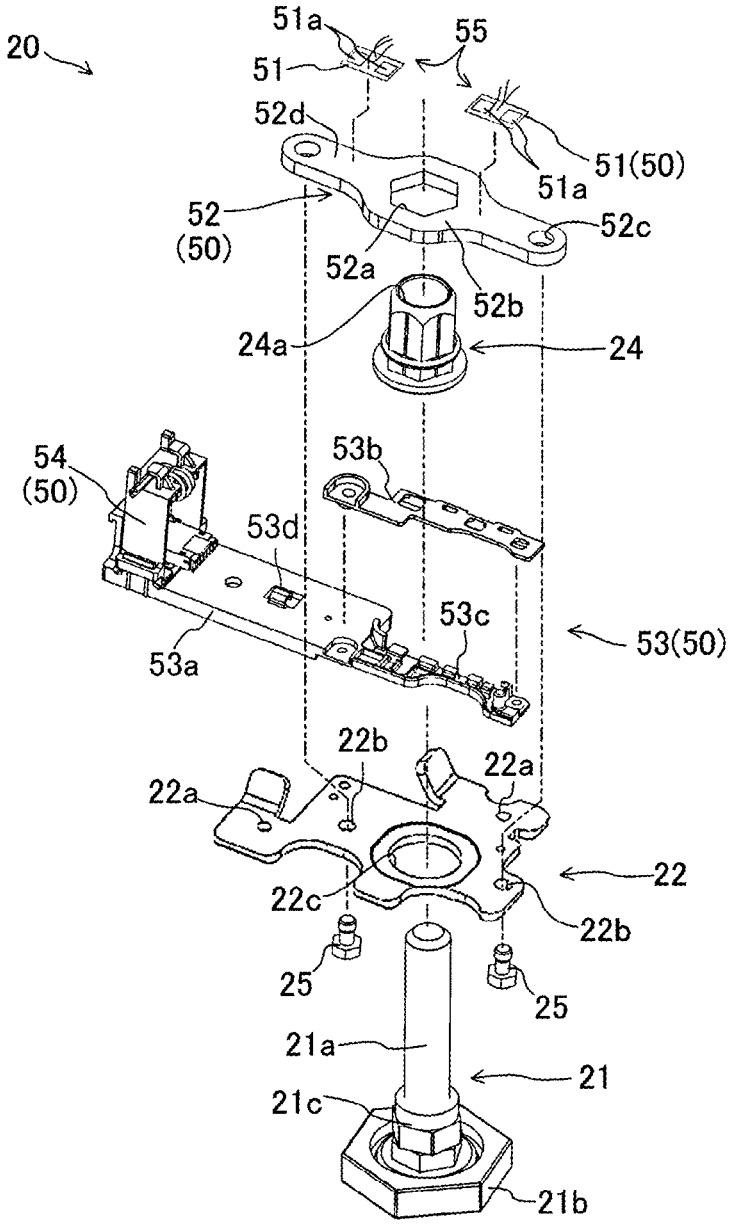
FIG. 5 is a schematic exploded perspective view of a unit leg portion according to an embodiment of the disclosure.

FIG. 3 is a schematic cross-sectional perspective view of the unit leg portion 20 coupled to the housing 2, according to an embodiment of the disclosure. FIG. 4 is a schematic perspective view of the unit leg portion 20 according to an embodiment of the disclosure. FIG. 5 is a schematic exploded perspective view of the unit leg portion 20 according to an embodiment of the disclosure. Referring to FIGS. 3 to 5, the unit leg portion 20 may include the support leg 21, the reinforcement bracket 22, and the weight measurement device 50. The weight measurement device 50 may be supported on the support leg 21 by a shaft support boss 24.

The weight measurement device 50 may include a strain gauge 51 and the strain-producing body 52. The strain-producing body 52 may be referred to herein as a straining body 52. The weight measurement device 50 may further include a wire guide 53 and an amplification circuit 54. The amplification circuit 54 may amplify a weak detection signal (an output voltage of strain detection devices 51*a*) that is input from the strain gauge 51, for example, the strain detection devices 51*a* described below and may output the amplified weak detection signal, for example, to the control device 8. The wire guide 53 may be coupled to the reinforcement bracket 22 and may support the amplification circuit 54. The wire guide 53 may have a structure to guide first lead lines 55 described below to the amplification circuit 54.

The strain gauge 51 may be configured to detect deformation of the strain-producing body 52. The strain gauge 51 may include a well-known member. In the washing machine 1 according to the present embodiment of the disclosure, the strain gauge 51 including two strain detection devices 51*a* arranged at a rectangular-shaped base may be used. A half bridge circuit may be formed by the two strain detection devices 51*a*.

The strain-producing body 52 may include a long thin plate-shaped member having excellent strength and rigidity. As described below, there are cases in which a dryer 60 may be arranged above the washing machine 1, and thus, the weight to be withstood per leg portion 20 may be, for example, 100 kg or greater. To withstand this weight by having a thin-plate shape, the strain-producing body 52 may include a material having high strength and high rigidity, for example, chrome molybdenum steel (for example, the Japanese industrial standard SCM440). In the case of the washing machine 1, corrosion resistance is required. Chrome molybdenum steel may become rusty, and thus, it is desirable to perform an antirust process. A surface of the strain-producing body 52 may be nickel-plated to satisfy the requirement of high strength and corrosion resistance.

The support leg 21 may be supported on the strain-producing body 52. For example, both ends of the strain-producing body 52 may be fixed to the reinforcement bracket 22. The support leg 21 may be supported on a central portion of the strain-producing body 52, for example, between both ends of the strain-producing body 52.

According to an embodiment of the disclosure, the strain-producing body 52 may include a base portion 52*b* in which a boss fixing hole (for example, a hexagonal hole 52*a*) is formed and a pair of arm portions 52*d* extending from both ends of the base portion 52*b* in different directions from each other and each having an end on which a screw hole 52*c* is formed. The strain gauge 51 may be coupled to the strain-producing body 52 and may detect deformation of the strain-producing body 52. For example, the strain gauge 51 may be mounted on an upper surface of each of the pair of arm portions 52*d*. That is, one strain-producing body 52 may include two strain gauges 51.

Each strain gauge 51 may be arranged such that the two strain detection devices 51*a* are aligned in a lengthwise direction of the arm portions 52*d*. Thus, by using the total of four strain detection devices 51*a*, both extension and contraction of the strain-producing body 52 may be measured. A full bridge circuit may be formed by the four strain detection devices 51*a* included in one strain-producing body 52.

The shaft support boss 24 may include a hexagonal cylindrical member having a flange at a lower end thereof. A shaft hole 24*a* into which a screw shaft portion 21*a* of the support leg 21 is inserted may be formed in a central portion of the shaft support boss 24. The shaft support boss 24 may be pressed against the hexagonal hole 52*a* of the strain-producing body 52 from a lower direction and may be fixed to the strain-producing body 52 not to be rotatable.

The support leg 21 may include the screw shaft portion 21*a*, a ground plate 21*b*, and a fixing member 21*c*. The screw shaft portion 21*a* may be cylindrical-shaped and may have an outer circumferential surface on which a male screw is formed. The screw shaft portion 21*a* may be supported by the shaft support boss 24 by being inserted into the shaft support boss 24 to be movable in an axial direction, for example, an up and down direction. The ground plate 21*b* having a hexagonal plate shape and supported on the mounting surface F may be coupled to a lower end portion of the screw shaft portion 21*a* to be rotatable. The fixing member 21*c* may include a cylindrical-shaped nut member and may have an inner surface on which a female screw is formed to be screw-coupled to the screw shaft portion 21*a*. The height of the leg portions 20 may be adjusted by fastening or loosening the fixing member 21*c* to or from the screw shaft portion 21*a*.

Referring to FIG. 5, the reinforcement bracket 22 may include a plate-shaped member having excellent strength and rigidity and may have a shape to correspond to a shape of the lower surface 2*d* of the housing 2. Two first fastening holes 22*a*, two second fastening holes 22*b*, and one shaft opening 22*c* may be formed on a flat surface portion of the reinforcement bracket 22. An inner diameter of the shaft opening 22*c* may be greater than a diameter of the shaft support boss 24 or the fixing member 21*c*.

Referring to FIG. 2, a fixing bolt 23 may be inserted into each of the first fastening holes 22*a* from bottom to top and the fixing bolt 23 may be fastened to the lower surface 2*d* of the housing 2. Accordingly, the reinforcement bracket 22 may be fixed to the housing 2. A rivet, etc. may be used, rather than the fixing bolt 23.

Referring to FIGS. 2 and 3, the strain-producing body 52 to which the shaft support boss 24 is fixed may be arranged above the reinforcement bracket 22. A fastening bolt 25 may be inserted into each of the second fastening holes 22*b* from bottom to top. The fastening bolt 25 may be fastened to the screw hole 52*c* of the strain-producing body 52, and thus, the strain-producing body 52 to which the shaft support boss 24 is fixed may be fixed to the reinforcement bracket 22. Thus, with both ends of the strain-producing body 52 fixed to the reinforcement bracket 22, the strain-producing body 52 may support the support leg 21 through the shaft support boss 24 fixed in the central portion of the strain-producing body 52.

The both ends of the strain-producing body 52 may be supported on the reinforcement bracket 22, and thus, fine detection of deformation may be possible and the strength and rigidity to withstand the increased weight may be obtained. The strain-producing body 52 may be attached onto the reinforcement bracket 22, and thus, when the unit leg portion 20 is coupled to the housing 2, the strain-producing body 52 may be accommodated in the accommodation concave portion 14 between the housing 2 and the reinforcement bracket 22. That is, the strain-producing body 52 may be accommodated in the accommodation concave portion 14 provided in the housing 2, and the reinforcement bracket 22 may protect the lower portion of the accommodation concave portion 14, and thus, the strain-producing body 52 may be effectively protected from external contacts or shocks.

The support leg 21 may be supported on the reinforcement bracket 22 through the strain-producing body 52 which is not in contact with the housing 2. Thus, the entire weight applied on the leg portion 20 may be applied to the strain-producing body 52, and thus, the weight applied on the leg portion 20 may be measured with high precision.

Referring to FIG. 5, the wire guide 53 may include a strip plate-shaped member. The wire guide 53 may include a plastic material. The wire guide 53 may include a main member 53*a* and a sub-member 53*b* coupled to the main member 53*a*. The sub-member 53*b* may be assembled to a side end of the main member 53*a* in a lengthwise direction of the main member 53*a*. The amplification circuit 54 may be coupled to an upper surface of another side end of the main member 53*a* in the lengthwise direction of the main member 53*a*. Referring to FIG. 3, the amplification circuit 54 may be inserted into the housing 2 through an opening 2*c* in the lower surface 2*d* of the housing 2, when the unit leg portion 20 is coupled to the housing 2.

At the side end of the main member 53*a*, a lead line accommodation portion 53*c* accommodating a plurality of first lead lines 55 (see FIG. 5) having small line diameters, the plurality of first lead lines 55 extending from each strain gauge 51, may be formed. The sub-member 53*b* may be assembled to the main member 53*a* to cover an upper portion of the lead line accommodation portion 53*c*. For example, the sub-member 53*b* may be coupled to the main member 53*a* through a screw. The wire guide 53 may be attached onto the reinforcement bracket 22 such that the lead line accommodation portion 53*c* may be located at a side of the strain-producing body 52. For example, the wire guide 53 may be coupled to the reinforcement bracket 22 through a screw.

The first lead lines 55 may be withdrawn from an inner portion of the lead line accommodation portion 53*c* and may be connected to an input terminal of the amplification circuit 54. As illustrated in FIG. 4, a lead line guide 53*d* may be provided in the main member 53*a* to guide the first lead lines 55 withdrawn from the inner portion of the lead line accommodation portion 53*c* not to float from an upper surface of the main member 53*a*. Thus, the first lead lines 55 may be withdrawn from the inner portion of the lead line accommodation portion 53*c* and may be guided through the upper surface of the main member 53*a* to be connected to the input terminal of the amplification circuit 54.

The wire guide 53 may be attached onto the reinforcement bracket 22 like the strain-producing body 52, and thus, while the unit leg portion 20 is being coupled to the housing 2, a side end of the wire guide 53 may be located between the housing 2 and the reinforcement bracket 22. Thus, the wire guide 53 may be effectively protected from external contacts or shocks, the first lead lines 55 may be effectively protected, despite having minute line diameters, and disconnection of the first lead lines 55 may be prevented.

Second lead lines 56 having relatively increased line diameters according to the standards of the washing machine 1 may be connected to an output terminal of the amplification circuit 54.

Figure 6:
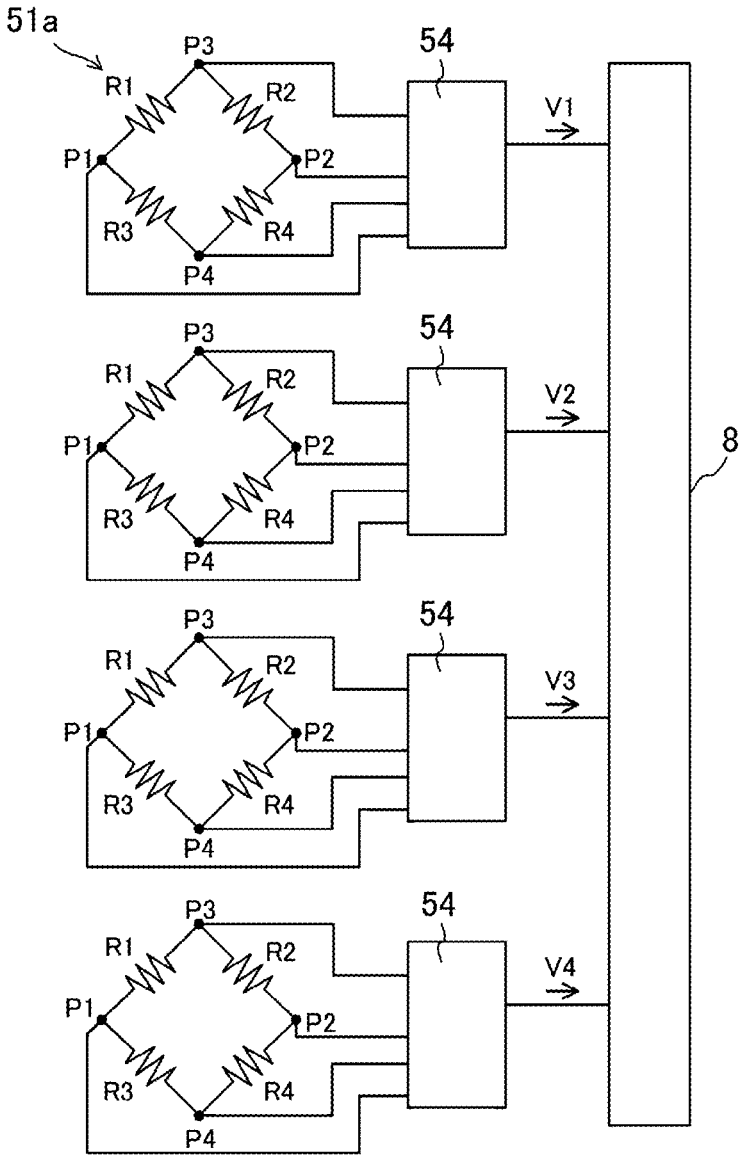
FIG. 6 shows a circuit structure of a weight measurement device according to an embodiment of the disclosure.

FIG. 6 shows a circuit structure of the weight measurement device 50, according to an embodiment of the disclosure. The weight measurement device of each of the four leg portions 20 located at the front, rear, right, and left portions of the lower surface 20*d* of the housing 2 may include the four strain detection devices 51*a*, and the four strain detection devices 51*a* may form a full bridge circuit as illustrated in FIG. 6. Thus, four full bridge circuits may be formed, and the control device 8 may measure the weights applied to the four leg portions 20 from measurement values of the four full bridge circuits.

In FIG. 6, R1, R2, R3, and R4 may respectively correspond to the four strain detection devices 51*a* provided in the two strain gauges 51 of each weight measurement device 50. The full bridge circuit of each weight measurement device 50 may be connected to the control device 8 through the amplification circuit 54.

When R1 and R4 contract, R2 and R3 may extend, and when R1 and R4 extend, R2 and R3 may contract. A certain voltage (an apply voltage) may be input between P1 and P2 of the full bridge circuit and a voltage (an output voltage) between P3 and P4 may be output to the amplification circuit 54. The output voltages of four full bridge circuits may be amplified to V1 to V4, respectively, by the amplification circuit 54 and then may be output to the control device 8.

The control device 8 may calculate the weight applied to each leg portion 20 based on each of the voltage values V1 to V4, input from each weight measurement device 50, as described above. Also, the control device 8 may measure the weight of laundry (laundry weight measurement processing) based on a change of the weight applied to each leg portion 20 or avoid increase in vibration of the housing 2 occurring due to resonance (resonant vibration suppression processing).

Figure 7:
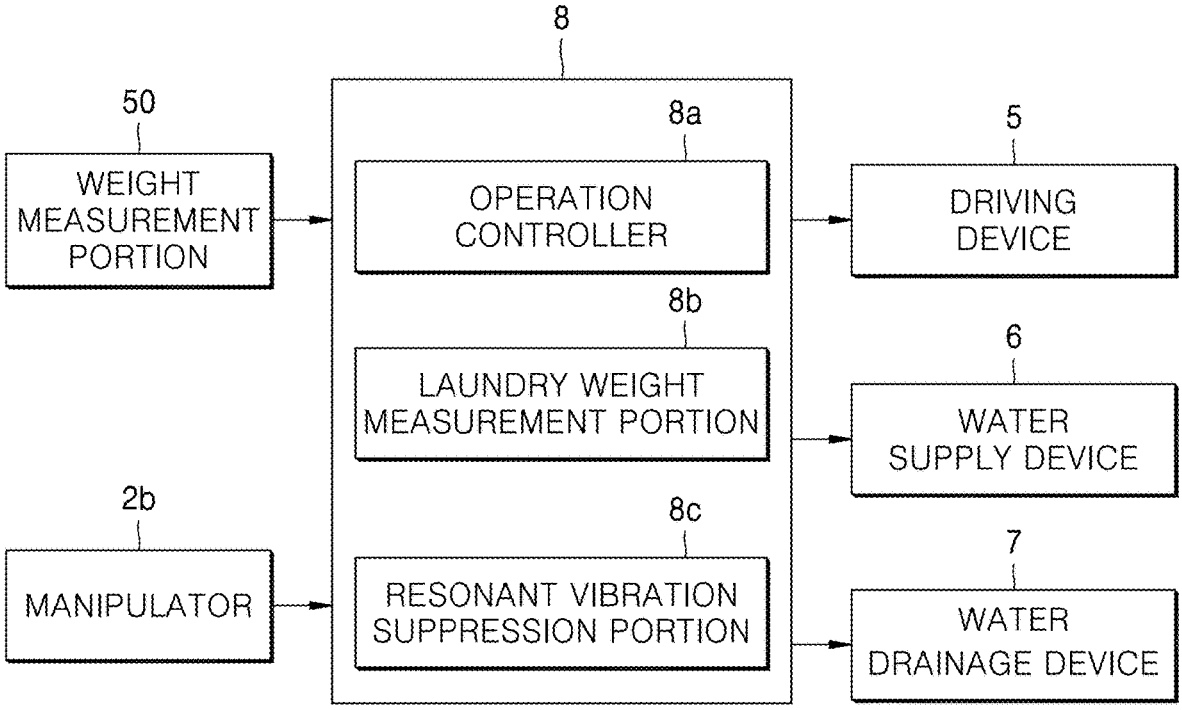
FIG. 7 is a block diagram showing an example of a relationship between a control device and main devices.

FIG. 7 is a block diagram showing an example of a relationship between the control device 8 and the main devices. Referring to FIG. 7, the control device 8 may include an operation controller 8*a*, a laundry weight measurement portion 8*b*, a resonant vibration suppression portion 8*c*, etc., as functional components.

The operation controller 8*a* may control an overall operation of the washing machine 1 according to a manipulation input through the manipulator 2*b*. The control device 8 may control operations of the driving device 5, the water supply device 6, and the water drainage device 7 to perform a series of processes including washing, rinsing, dewatering, etc.

The laundry weight measurement portion 8*b* may measure a laundry weight (laundry weight measurement processing) based on a measurement result of the weight measurement device 50 provided at each leg portion 20, that is, a signal input from each weight measurement device 50. In detail, when laundry is input to the drum 4, the laundry weight measurement portion 8*b* may measure the laundry weight from a change of the weight applied to each leg portion 20 according thereto. A change of the weight of the washing machine 1 may be measured based on the weights applied to the weight measurement devices 50 at four positions, and thus, the laundry weight may be directly measured with high precision.

Also, the control device 8 may also measure the amount of water supply based on the weight applied to each leg portion 20, in other words, based on the measurement result of the weight measurement device 50 provided on each leg portion 20, and thus, high level washing may be performed. Also, the control device 8 may also measure the horizontality of the washing machine 1 based on the weight applied to each leg portion 20, in other words, based on the measurement result of the weight measurement device 50 provided on each leg portion 20, and thus, the horizontality of the washing machine 1 may be determined with high precision. The height of the leg portion 20 may be adjusted according to the measured horizontality by using the fixing member 21*c*, and thus, the horizontality may be adjusted to a desired value.

Figure 8:
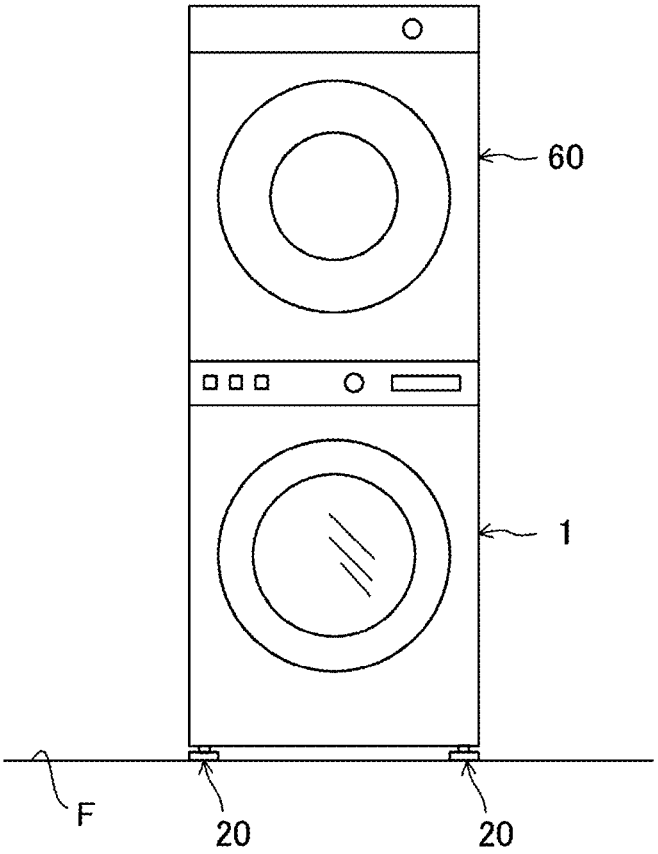
FIG. 8 shows an example of a washer-dryer unit.

FIG. 8 shows an example of a washer-dryer unit. Referring to FIG. 8, the washing machine 1 according to the disclosure may be formed as a washer-dryer unit by having the certain dryer 60 (an example of an attached device) arranged thereabove.

In the case of the washer-dryer unit, the weight applied to each leg portion 20 may be greater than 100 kg. For example, the weight of about 130 kg may be applied to each leg portion 20. Thus, as described above, the high strength and rigidity to withstand an increased weight may be required for each leg portion 20. Also, during the dewatering processing, due to the effect of a decreased resonant frequency between the washer-dryer unit and the mounting surface F, a possibility of increase in vibration of the housing 2 may increase, with the matching of the number of dewatering revolutions with the resonant frequency, particularly in a maintenance section for maintaining the number of dewatering revolutions constant. Thus, in the case of the washer-dryer unit having an increased length in a vertical direction (an up and down direction), a user may feel uncomfortable or insecure due to increased noise or vibration.

The washing machine 1 according to the disclosure may be designed to avoid the matching of the number of dewatering revolutions with the resonant frequency in a section in which the number of dewatering revolutions is maintained constant, based on a measurement result by the weight measurement device 50. The resonant vibration suppression portion 8*c* may detect, based on the measurement result of the weight measurement device 50, the occurrence of increase in vibration of the housing 2 due to resonance, and may avoid the increase in vibration of the housing 2 (resonant vibration suppression processing). For example, the number of dewatering revolutions (a first number of dewatering revolutions) set as the number of revolutions of the drum 4 in the maintenance section of the dewatering process may be changed to the different number of dewatering revolutions (a second number of dewatering revolutions), and thus, the time during which increased vibration or noise occurs may be suppressed to a minimum length. The second number of dewatering revolutions may refer to the number of revolutions which is different from the resonant frequency.

Figure 9:
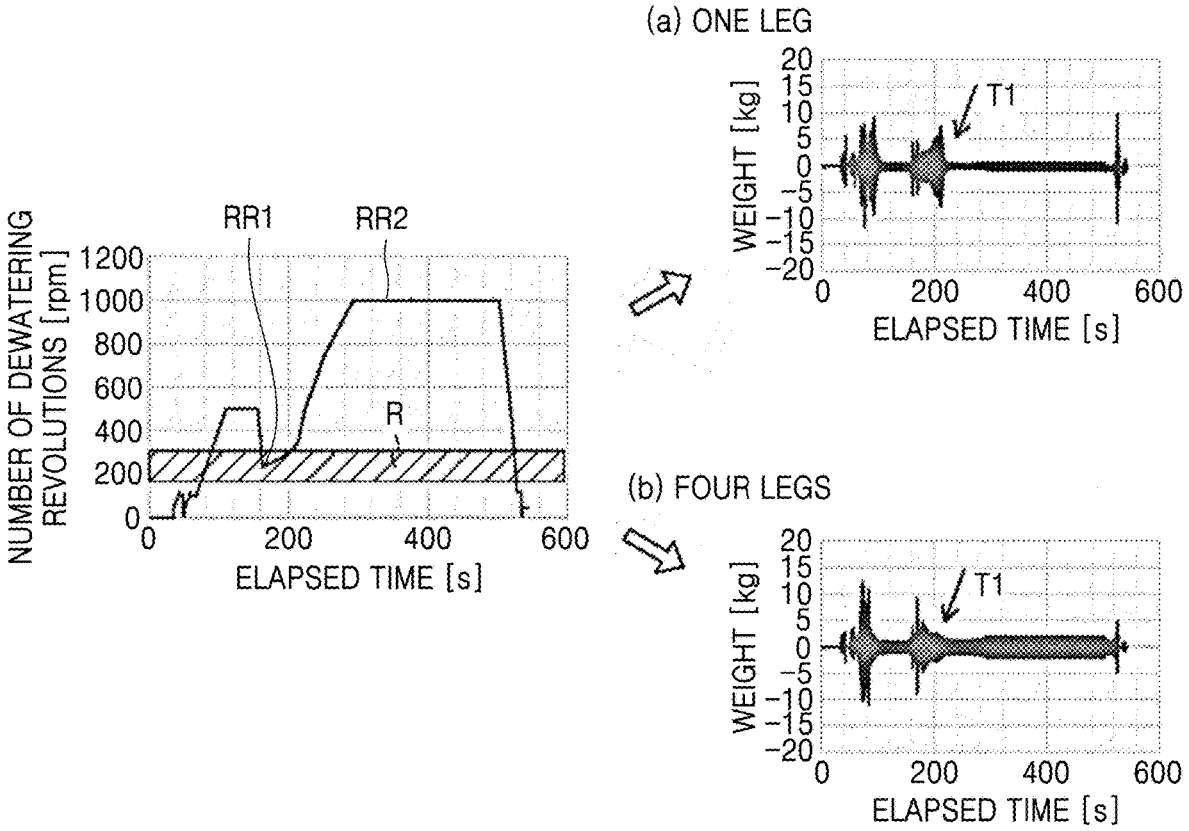
FIG. 9 shows an example of a test result with respect to suppression of increase in housing vibration (resonant vibration) due to resonance.

FIG. 9 shows an example of a test result with respect to suppression of increase in vibration (resonant vibration) of the housing 2 due to resonance. The left graph of FIG. 9 shows a change of the number of drum revolutions over time during a dewatering process of a washer-dryer unit. The range R shown by a diagonal line in the left graph indicates a resonant frequency band between the washer-dryer unit and the mounting surface F. The upper right graph (a) of FIG. 9 shows a change of the weight measured by one leg portion 20 over time during the dewatering process illustrated in the left graph. The lower right graph (b) of FIG. 9 shows a change of the summed value (for example, amounting to the weight change of the washing machine 1) of the weights measured by the four leg portions 20 over time during the dewatering process illustrated in the left graph.

As shown by an arrow Y1 in the upper right graph (a) and the lower right graph (b), regarding the amplitude of the weight after 200 seconds, an increase is observed in the weight measured by one leg portion 20, but an increase is not observed in the summed value of the weights measured by the four leg portions 20. That is, there may be cases in which an increase or a decrease in the weight measured by the four leg portions 20 may be offset by each other, and thus, increase in vibration of the housing 2 due to resonance may not be detected. By taking this aspect into account, the resonant vibration suppression portion 8*c* of the washing machine 1 according to the disclosure may avoid increase in vibration of the housing 2, based on a measurement value of any one of the measurement devices 50. For example, when a first number of dewatering revolutions RR1 in the maintenance section during the dewatering process matches with a resonant frequency band R as shown in the left graph of FIG. 9, the weight measured by one leg portion 20 may be increased as indicated by the arrow Y1 in the upper right graph (a) of FIG. 9. Then, the resonant vibration suppression portion 8*c* may control the driving device 5 to change the number of revolutions of the drum 4 in the maintenance section to a second number of dewatering revolutions RR2 as indicated in the left graph of FIG. 9. The second number of dewatering revolutions RR2 may not overlap the resonant frequency band R. Thus, during the dewatering process, the increased vibration of the housing 2 due to resonance in particular in the maintenance section, and noise occurrence according to the increase in vibration may be reduced.

The washing machine 1 according to the disclosure is not limited to the embodiments of the disclosure described above. For example, the washing machine 1 is not limited to the drum-type washing machine and may include a top-loading type washing machine. According to the embodiments of the disclosure described above, the strain-producing body 52 is described as having a thin-plate shape having a uniform thickness, but the strain-producing body 52 is not limited thereto. A groove extending in a direction of a short side may be formed in an area of a lower surface of each arm portion 52*d*, the area corresponding to an area between the two strain detection devices 51*a* of each strain gauge 51. Here, the direction of the short side may be orthogonal to an extension direction of the arm portion 52*d*. Accordingly, the strain-producing body 52 may be deformed by a reduced weight, and thus, the sensitivity of the strain gauge 51 may be improved.

The attached device mounted on the washing machine 1 is not limited to the dryer 60. For example, the attached device may include other devices, such as a shelf, etc.

The strain-producing body 52 having a two-point support structure having two support points (screw holes 52*c*) provided at the pair of arm portions 52*d* is described as an example. However, the strain-producing body 52 having three or more support points may be used for the weight measurement device 50. In this case, shapes of the strain-producing body may include a cross shape, a discoid shape, etc.

When the amplification circuit 54 may be arranged around the support leg 21, the wire guide 53 may have a rectangular plate shape, and the wire guide 53 may be omitted and the amplification circuit 54 may be coupled to the reinforcement bracket 22. Also, the amplification circuit 54 may be provided on the control device 8. In this case, a bridging terminal (not shown) bridging the first lead lines 55 between the strain gauges 51 and the control device 8 may be mounted on the wire guide 53. The structure in which one amplification circuit 54 is mounted per unit leg 20 is described as an example. However, the disclosure is not limited thereto. One amplification circuit 54 may be arranged between the unit leg portions 20 and the control device 8. In this case, a bridging terminal (not shown) bridging the first lead lines 55 between the strain gauges 51 and the amplification circuit 54 may be mounted on the wire guide 53.

According to an embodiment of the disclosure, a washing machine includes a housing supported on a mounting surface by a plurality of leg portions 20, a tub accommodated in the housing and capable of retaining water, and a drum accommodated in the tub to be rotatable. The leg portion includes a support leg supporting the housing on the mounting surface such that a lower surface of the housing is apart from the mounting surface, a reinforcement bracket coupled to the lower surface of the housing, and a weight measurement device coupled to the reinforcement bracket to be located between the lower surface of the housing and the reinforcement bracket, supported on the support leg, and configured to measure a weight applied on the leg portion.

Accordingly, because the weight measurement device is located between the lower surface of the housing and the reinforcement bracket, the weight measurement device is protected by the reinforcement bracket even when a pellet, a fork, etc. are inserted below the washing machine. Thus, damage to the weight measurement device may be reduced or prevented. Also, by implementing the reinforcement bracket, the leg portion having the strength and rigidity to withstand an increased weight may be realized.

According to an embodiment of the disclosure, the reinforcement bracket, the support leg, and the weight measurement device may integrally form a unit leg portion. Accordingly, the weight measurement device may be coupled to the housing by coupling the leg portion to the housing, and thus, excellent yield may be realized and the weight measurement device may be easily replaced.

According to an embodiment of the disclosure, an accommodation concave portion may be recessed on the lower surface of the housing to accommodate the weight measurement device. According to an embodiment of the disclosure, the reinforcement bracket may be coupled to the lower surface of the housing to cover the accommodation concave portion while the weight measurement device is being accommodated in the accommodation concave portion. Accordingly, because the weight measurement device may be accommodated in the accommodation concave portion, the risk of damage to the weight measurement device may further be reduced or prevented.

According to an embodiment of the disclosure, the weight measurement device may include a strain-producing body having both ends fixed to the reinforcement bracket and a central portion to which the support leg is fixed, and a strain gauge coupled to the strain-producing body and configured to detect deformation of the strain-producing body. Because the both ends of the strain-producing body may be fixed to the reinforcement bracket, the weight measurement device having the strength and rigidity to withstand an increased weight may be easily realized. Also, because the support leg is supported on the central portion of the strain-producing body, the weight applied on the leg portion may be intactly applied to the strain-producing body. Thus, the strain-producing body may be easily deformed to improve the precision of weight measurement.

According to an embodiment of the disclosure, the strain-producing body may include chrome molybdenum steel. According to an embodiment of the disclosure, an antirust process may be performed on a surface of the strain-producing body. An increased weight may be applied to the strain-producing body. Thus, by using the chrome molybdenum steel having the excellent strength and rigidity, the strain-producing body may be formed to have a thin-plate shape to make the leg portion compact. Chrome molybdenum steel may have less corrosion resistance than stainless steel, and thus, the antirust process may be performed on the surface of the strain-producing body to realize the strain-producing body having the high strength, rigidity, and corrosion resistance.

According to an embodiment of the disclosure, the weight measurement device may further include an amplification circuit configured to amplify and output a detection signal input from the strain gauge, and a wire guide supporting the amplification circuit and coupled to the reinforcement bracket. A first lead line extending from the strain gauge may be guided along a surface of the wire guide to be connected to the amplification circuit. Also, the first lead line connected to the strain gauge may have a small line diameter and be delicate, so as to be easily disconnected. Because the first lead line may be guided along the surface of the wire guide, the risk of disconnection of the first lead line may be reduced.

According to an embodiment of the disclosure, the wire guide may include a main member having an end at which a lead line accommodation portion accommodating the first lead line extending from the strain gauge is provided and another end to which the amplification circuit is coupled and a sub-member coupled to the main member to cover the lead line accommodation portion. A lead line guide configured to guide the first lead line, which is withdrawn from the lead line accommodation portion, not to be float from an upper surface of the main member, may be provided in the main member.

According to an embodiment of the disclosure, the strain-producing body may further include a base portion and a pair of arm portions extending from both ends of the base portion. The strain gauge may be coupled to each of the pair of arm portions.

According to an embodiment of the disclosure, each strain gauge may include two detection devices. The detection devices may be arranged in a lengthwise direction of the pair of arm portions.

According to an embodiment of the disclosure, the washing machine may further include a shaft support boss fixed by being inserted into a boss fixing hole provided in the base portion of the strain-producing body. The support leg may include a screw shaft portion inserted in a shaft hole provided in the shaft support boss and a ground plate coupled to a lower end of the screw shaft portion and supported on the mounting surface. Accordingly, the height of the leg portion may be adjusted by using the support leg. Also, the horizontality of the washing machine may be detected based on a measurement result of the weight measurement device, and the horizontality of the washing machine may be adjusted with high precision by adjusting the height of the leg portion.

According to an embodiment of the disclosure, the washing machine may further include a control device configured to perform, based on a measurement result of the weight measurement device provided on each of the plurality of leg portions, a laundry weight measurement process to measure a weight of laundry accommodated in the drum. Because the weight of the laundry may be measured with high precision by detecting the weight applied to each leg portion, a high-quality washing process may be possible.

According to an embodiment of the disclosure, the washing machine may further include a control device configured to perform, based on a measurement result of the weight measurement device provided on each of the plurality of leg portions, a resonant vibration suppression process to avoid an increase of resonant vibration during a dewatering process. According to an embodiment of the disclosure, the control device may further be configured to maintain a number of revolutions of the drum as a first number of dewatering revolutions in a maintenance section for maintaining the number of revolutions of the drum constant during the dewatering process. The control device may further be configured to detect, based on the measurement result of the weight measurement device provided on each of the plurality of leg portions, an occurrence of increase in vibration of the housing, and change the number of revolutions of the drum in the maintenance section to a second number of dewatering revolutions which is different from the first number of dewatering revolutions.

When an attached device such as a dryer, etc. is arranged on the washing machine, vibration of the housing may be increased due to resonance, and this vibration may continually occur in a maintenance section during a dewatering process. According to the disclosure, increase in vibration of the housing may be detected from a measurement result of the weight measurement device. In this case, by changing the number of revolutions of the drum in the maintenance section from the first number of dewatering revolutions to the second number of dewatering revolutions which is different from the resonant frequency, the performance of the washing machine may be improved. As descried above, according to the washing machine according to the disclosure, while obtaining the strength and rigidity of the leg portion for withstanding the increased weight, the weight of the washing machine may be highly precisely measured, and thus, the increase in vibration of the housing due to resonance or the weight of the laundry, etc. may be highly precisely measured. Also, the assemblability of the leg portion including the weight measurement device may be excellent, and thus, the yield rate of the washing machine may be improved.

However, the technical effects to be achieved by the disclosure are not limited to the technical effects described above, and other technical effects that are not described above may be clearly understood by one of ordinary skill in the art from the description below.

As described above, the washing machine according to the disclosure is described according to limited embodiments and drawings. However, the disclosure is not limited to the embodiments described above and may allow various modifications within the range not deviating from the purpose of the disclosure.

The invention claimed is:

1. A washing machine comprising:

a housing;

a tub accommodated in the housing and configured to retain water;

a drum accommodated in the tub and configured to be rotatable; and a plurality of leg portions configured to be couplable to the housing to support the housing on a mounting surface, wherein each leg portion of the plurality of leg portions includes:

a support leg, a reinforcement bracket configured to be couplable to a lower surface of the housing below the lower surface of the housing, and a weight measurement device configured to be couplable to the reinforcement bracket, wherein the each leg portion is configured so that, when the weight measurement device is coupled to the reinforcement bracket and the reinforcement bracket is coupled to the lower surface of the housing:

the housing is supported on the support leg so that a lower surface of the housing is spaced apart from the mounting surface, and the weight measurement device is supported on the support leg and located between the lower surface of the housing and the reinforcement bracket, and measures a weight applied on the each leg portion.

2. The washing machine of claim 1, wherein the reinforcement bracket, the support leg, and the weight measurement device integrally form a unit leg portion.

3. The washing machine of claim 1, wherein an accommodation concave portion is recessed on the lower surface of the housing to accommodate the weight measurement device.

4. The washing machine of claim 3, wherein when the weight measurement device is coupled to the reinforcement bracket and the reinforcement bracket is coupled to the lower surface of the housing, the reinforcement bracket covers the accommodation concave portion and the weight measurement device is accommodated in the accommodation concave portion.

5. The washing machine of claim 1, wherein the weight measurement device includes:

a straining body having a first end, a second end, and a central portion, and a strain gauge coupled to the straining body and configured to detect deformation of the straining body, and when the weight measurement device is coupled to the reinforcement bracket and the reinforcement bracket is coupled to the lower surface of the housing, the first end of the straining body and the second end of the straining body are fixed to the reinforcement bracket, and the central portion of the straining body is fixed to the support leg.

6. The washing machine of claim 5, wherein the straining body includes chrome molybdenum steel.

7. The washing machine of claim 5, wherein the straining body includes an antirust processed surface.

8. The washing machine of claim 5, wherein the weight measurement device includes:

an amplification circuit configured to amplify and output a detection signal input from the strain gauge, a wire guide supporting the amplification circuit, and a first lead line extending from the strain gauge and guided along a surface of the wire guide to be connected to the amplification circuit, and when the weight measurement device is coupled to the reinforcement bracket, the wire guide is coupled to the reinforcement bracket.

9. The washing machine of claim 8, wherein the wire guide includes:

a main member having a first end and a second end, the amplification circuit being coupled to the first end of the main member, a lead line accommodation portion at the second end of the main member and accommodating the first lead line extending from the strain gauge, a sub-member coupled to the main member to cover the lead line accommodation portion, and a lead line guide configured in the main member to guide a portion of the first lead line extending from the lead line accommodation portion so as not to float from an upper surface of the main member.

10. The washing machine of claim 5, wherein the straining body includes:

a base portion having a first end and a second end, and a pair of arm portions extending respectively from the first end of the base portion and the second end of the base portion, and the strain gauge is coupled to each arm portion of the pair of arm portions.

11. The washing machine of claim 10, wherein the strain gauge includes two detection devices, and the two detection devices are arranged in a lengthwise direction of the pair of arm portions.

12. The washing machine of claim 10, further comprising:

a shaft support boss that is insertable into a boss fixing hole in the base portion of the straining body, wherein the support leg includes:

a screw shaft portion that is insertable in a shaft hole in the shaft support boss, and a ground plate coupled to a lower end of the screw shaft portion, and configured to be supportable on the mounting surface.

13. The washing machine of claim 1, further comprising:

a control device configured to perform, based on a measurement result of the weight measurement device on the each leg portion, a laundry weight measurement process to measure a weight of laundry accommodated in the drum.

14. The washing machine of claim 1, further comprising:

a control device configured to perform, based on a measurement result of the weight measurement device on the each leg portion, a resonant vibration suppression process to avoid an increase of resonant vibration during a dewatering process.

15. The washing machine of claim 14, wherein the control device is configured to:

maintain a number of revolutions of the drum as a first number of dewatering revolutions in a maintenance section for maintaining the number of revolutions of the drum to be constant during the dewatering process, and detect, based on the measurement result of the weight measurement device on the each leg portion, an occurrence of increased vibration of the housing, and change the number of revolutions of the drum in the maintenance section to a second number of dewatering revolutions which is different from the first number of dewatering revolutions.

* * * * *